US011142716B2

(12) United States Patent
Hu et al.

(10) Patent No.: US 11,142,716 B2
(45) Date of Patent: Oct. 12, 2021

(54) REGENERATION METHOD FOR LIQUEFIED PETROLEUM GAS SWEETENING CAUSTIC

(71) Applicant: PetroChina Company Limited, Beijing (CN)

(72) Inventors: Xuesheng Hu, Beijing (CN); Fei Gao, Beijing (CN); Shengbao He, Beijing (CN); Yingwen Li, Beijing (CN); Xiao Li, Beijing (CN); Ming Fan, Beijing (CN); Weigang Dong, Beijing (CN); Jing Chen, Beijing (CN); Wei Li, Beijing (CN); Qing Hu, Beijing (CN); Yuan Wang, Beijing (CN); Huaqun Zhou, Beijing (CN)

(73) Assignee: PetroChina Company Limited, Beijing (CN)

( * ) Notice: Subject to any disclaimer, the term of this patent is extended or adjusted under 35 U.S.C. 154(b) by 0 days.

(21) Appl. No.: 16/650,942

(22) PCT Filed: Apr. 12, 2019

(86) PCT No.: PCT/CN2019/082573

§ 371 (c)(1),
(2) Date: Mar. 26, 2020

(87) PCT Pub. No.: WO2019/196951

PCT Pub. Date: Oct. 17, 2019

(65) Prior Publication Data

US 2020/0291320 A1 Sep. 17, 2020

(30) Foreign Application Priority Data

Apr. 13, 2018 (CN) ..... 201810331691.1

(51) Int. Cl.

| | |
|---|---|
| ***C10G 19/08*** | (2006.01) |
| ***C10L 3/10*** | (2006.01) |
| ***C10L 3/12*** | (2006.01) |
| ***C10G 19/06*** | (2006.01) |
| ***C10G 27/06*** | (2006.01) |

(52) U.S. Cl.

CPC ..... *C10L 3/103* (2013.01); *C10G 19/06* (2013.01); *C10G 19/08* (2013.01); *C10G 27/06* (2013.01); *C10L 3/12* (2013.01); *C10L 2290/12* (2013.01)

(58) Field of Classification Search

CPC ..... C10G 19/08; C10G 27/06; C10G 25/00; C10G 25/12

See application file for complete search history.

(56) References Cited

U.S. PATENT DOCUMENTS

| | | | | |
|---|---|---|---|---|
| 2,853,432 | A * | 9/1958 | Gleim | C10G 19/08 208/284 |
| 2,882,132 | A * | 4/1959 | Nieuwenhuis | C10G 19/08 423/183 |
| 2,937,986 | A * | 5/1960 | Lukk | C10G 19/08 208/88 |
| 4,666,689 | A | 5/1987 | Maple et al. | |
| 6,565,740 | B2 * | 5/2003 | Sain | C10G 19/08 208/189 |
| 9,017,627 | B2 | 4/2015 | Gupta | |
| 2007/0034565 | A1 * | 2/2007 | Park | B01D 1/14 210/619 |
| 2009/0065434 | A1 * | 3/2009 | Zhang | C10G 19/08 210/668 |
| 2018/0170777 | A1 * | 6/2018 | Tertel | C10G 19/08 |
| 2018/0250633 | A1 * | 9/2018 | Besnault | C10G 19/08 |

FOREIGN PATENT DOCUMENTS

| | | | |
|---|---|---|---|
| CN | 85103113 | A | 10/1986 |
| CN | 101077981 | A | 11/2007 |
| CN | 101371967 | A | 2/2009 |
| CN | 101855175 | A | 10/2010 |
| CN | 102557300 | A | 7/2012 |
| CN | 103146416 | A | 6/2013 |
| CN | 104263403 | A | 1/2015 |
| CN | 104371782 | A | 2/2015 |
| CN | 104694151 | A | 6/2015 |
| CN | 104743726 | A | 7/2015 |
| CN | 105038850 | A | 11/2015 |
| CN | 105112092 | A | 12/2015 |
| CN | 204999859 | U | 1/2016 |
| CN | 106929089 | A | 7/2017 |
| CN | 106939172 | A | 7/2017 |
| CN | 107043636 | A | 8/2017 |
| CN | 108704480 | A | 10/2018 |

OTHER PUBLICATIONS

Chinese Search Report for Chinese Application No. 201810331691.1, "A Liquefied Gas Sweetening Lye Regeneration Method", dated Mar. 12, 2018.

International Search Report for International Application No. PCT/CN2019/082573, "Regeneration Method for Liquefied Gas Thiol-Removing Alkaline Solution", dated Jul. 10, 2019.

* cited by examiner

*Primary Examiner* — Michelle Stein

(74) *Attorney, Agent, or Firm* — Hamilton, Brook, Smith & Reynolds, P.C.

(57) ABSTRACT

A regeneration method for a liquefied gas thiol-removing alkaline solution comprising the following steps: performing an oxygenation reaction with respect to a liquefied gas thiol-removing alkaline solution and, at the same time, utilizing a high air-liquid condition to extract a disulfide and a polysulfide into a gas phase, thus completing the separation of the disulfide and the polysulfide from the alkaline solution, and implementing the regeneration of the liquefied gas thiol-removing alkaline solution.

14 Claims, No Drawings

REGENERATION METHOD FOR LIQUEFIED PETROLEUM GAS SWEETENING CAUSTIC

This application is the U.S. National Stage of International Application No. PCT/CN2019/082573, filed Apr. 12, 2019, which designates the U.S., published in Chinese and claims priority under 35 U.S.C. § 119 or 365(c) to Chinese Application No. 201810331691.1, filed Apr. 13, 2018. The entire teachings of the above applications are incorporated herein by reference.

TECHNICAL FIELD

The invention belongs to the field of oil refining technology, and particularly relates to a method for purifying liquefied petroleum gas sweetening caustic, in particular to a regeneration method for liquefied petroleum gas sweetening caustic.

BACKGROUND

In general, liquefied petroleum gas is sweetened by alkaline washing in a refining process. In a typical process, liquefied petroleum gas is brought into contact with a caustic in a sweetening unit for extraction, and the low molecular mercaptan which is acidic in the liquefied petroleum gas reacts with sodium hydroxide to form mercaptan sodium, which enters the caustic phase; the mercaptan sulfur in the liquefied petroleum gas is thus removed, and the total sulfur is lowered. A extraction tower or a fiber membrane contactor is generally used for alkaline washing and extraction, and a tower reactor is employed in oxidation regeneration of caustic containing mercaptan sodium. This is shown in the reaction formula (1):

$$RSH+NaOH \leftrightharpoons NaSR+H_2O \quad (1)$$

wherein R is an alkyl group and may be a methyl group, an ethyl group, a propyl group or the like.

The caustic containing mercaptan sodium is brought into contact with air in an oxidation tower, where disulfide and sodium hydroxide are generated from mercaptan sodium under the action of a sulfonated cobalt phthalocyanine-based catalyst. The resulting disulfide is insoluble in caustic and is separated from the caustic via gravity sedimentation in a disulfide sedimentation tank, and the regenerated caustic re-enters the extraction system for reuse. This is shown in the reaction formula (2):

$$4NaSR+2H_2O+O_2 \rightarrow 2R_1S_2R_2+4NaOH \quad (2)$$

wherein R, $R_1$ and $R_2$ are alkyl groups; R, $R_1$ and $R_2$ may be the same or different, and may be a methyl group, an ethyl group, a propyl group or the like.

There is generally a "pre-alkaline washing" process prior to alkaline washing. Liquefied petroleum gas is often washed with a caustic at a low concentration to remove 10-20 mg/$Nm^3$ of the residual hydrogen sulfide that has not been removed by amine washing upstream. The caustic for pre-alkaline washing contains a large amount of sodium sulfide and a small amount of mercaptan sodium. A tank, a static mixer, or a fiber membrane contactor is often used as a reactor for pre-alkaline washing. This is shown in the reaction formula (3):

$$H_2S+NaOH \rightarrow Na_2S+H_2O \quad (3)$$

The caustic for pre-alkaline washing is not regenerated in the classic Merox process; that is, it is discharged directly as a caustic sludge or left to be treated in a downstream wet air oxidation unit. In a fiber membrane sweetening process, pre-alkaline washing is generally eliminated. The part of the sodium sulfide formed upon the removal of hydrogen sulfide enters the oxidation tower along with the mercaptan sodium caustic produced from sweetening, and an oxidation reaction with oxygen in the air occurs under the action of a sulfonated cobalt phthalocyanine-based catalyst in which mercaptan sodium is oxidized to disulfide and sodium sulfide is oxidized to sodium thiosulfate. Only when mercaptan sodium and sodium sulfide are oxidized so as to generate sodium hydroxide completely, can the treated caustic be seen as effectively recycled, namely the complete regeneration of the caustic is achieved. When a reaction in which sodium sulfide is converted to sodium thiosulfate occurs, sodium hydroxide is only partly generated. The treated caustic still has a certain amount of sodium thiosulfate and cannot be reused; in other words, it is not completely regenerated and can only be disposed as a caustic sludge. This is shown in the reaction formula (4):

$$2Na_2S+2O_2+H_2O \rightarrow Na_2S_2O_3+2NaOH \quad (4)$$

The presence of sodium sulfide and its oxidation product, sodium thiosulfate in caustic is one of the important reasons for the degradation in the sweetening ability by extraction, which in turn results in the discharge of large amount of caustic sludge.

As shown in the reaction formula (2) and (4) in the prior art, due to the limitation of the mass transfer process of oxygen molecules and long residence time, the regeneration of mercaptan sodium and sodium sulfide occurs in mutually independent oxidation processes. Sodium sulfide is converted to sodium thiosulfate, and therefore the sodium sulfide-containing caustic cannot be fully regenerated. In other words, it is just a "post-processing technology", rather than a "complete regeneration technology".

CN104694151A discloses an oxidative regeneration method for mercaptan sodium-containing caustic which couples a mercaptan sodium oxidation process with a disulfide separation process in the same Higee device, where excellent caustic regeneration is achieved and the reactions are carried out only in the presence of an oxidation catalyst. This process only regenerates caustic containing mercaptan sodium, not including any caustic containing sodium sulfide. In general, in the related field, the caustic containing mercaptan sodium and sodium sulfide is generally regenerated separately, i.e., complete conversion of both cannot be achieved.

CN103146416A discloses a method for removing disulfide in caustic by using Higee technique, compressed air stripping the disulfide in caustic to 5 mg/kg or less. This process is only a stripping separation process and does not involve the addition of an oxidation catalyst, and therefore both mercaptan sodium and sodium sulfide are less susceptible to oxidation. Also, because an oxidation reaction is not involved, the gas used is nitrogen, air or fuel gas with an oxygen content of ≤20%. Furthermore, the disulfides involved are also only limited to dimethyl disulfide, methyl ethyl disulfide, diethyl disulfide, etc., no polysulfide included.

CN104743726A proposes an apparatus and method for harmlessly treating oil refining caustic sludge based on Higee oxidation, comprising reacting sodium sulfide and mercaptan sodium in the caustic sludge with non-purified air, so as to convert them into sodium thiosulfate and disulfide respectively. The amount of catalyst required for the oxidation process should be maintained in the range of 50-500 mg/kg. Because the bulk packing used in the Higee reactor has limited shear-crushing ability to the liquid, it cannot effectively enhance the mass transfer process of oxygen from the gas phase to the liquid phase. Therefore, this process can only convert sodium sulfide into sodium thiosulfate, which is not a complete reduction to sodium hydroxide. That is, the caustic containing both sodium sulfide and mercaptan sodium is not completely regenerated but only treated harmlessly.

CN101371967A discloses an oxidative regeneration method and apparatus for liquefied petroleum gas sweetening caustic. In this method, a small portion of the sweetened caustic is oxidized and regenerated to obtain a regenerated caustic, which is then blended with the majority of the caustic that is not regenerated and sent back into a sweetening reactor, thereby controlling the content of disulfide in the regenerated caustic. This method does not substantively improve the oxidation device and the separation device, and the quality of the recycled caustic is inferior because only part of the sweetening caustic is regenerated, which undermines the extraction effect of the regenerated caustic.

CN104263403A discloses a method and apparatus for deep oxidation and separation of disulfides in a sweetening caustic. In this method, the caustic to be regenerated and air are separately introduced into an oxidation tower through a liquid distributor and an air distributor, and disulfides are extensively extracted by a fiber membrane extraction contactor so as to improve the quality of the regenerated caustic. This method increases the conversion of mercaptan sodium in the oxidation tower only to a certain extent. When fiber membrane is applied in the extraction of disulfides, the fiber filaments have such a strict requirement for medium cleanliness that the filter or the pipeline may easily be clogged if the catalyst aggregates due to poor solubility or instability, and thus an effective removal of disulfides cannot be achieved.

CN102557300A discloses a device and a treatment method for sweetening and neutralization of liquefied petroleum gas caustic sludge. In the method, an all-phase contact microbubble oxidation technique is used to reduce the content of sodium sulfide and mercaptan sodium in the caustic sludge to less than 10 mg/kg. At the same time, a multi-stage all-phase contact microbubble carbonization technique is employed to completely neutralize the sodium hydroxide in the caustic sludge to sodium bicarbonate. The remaining sodium sulfide, mercaptan sodium, and disulfide are further reduced to 1 ppm or less, and the pH of the waste water produced is lowered to 8-9, with COD lowered to 1000 mg/L or less. In this process, sodium sulfide is converted to mercaptan sodium and sodium sulfate, but not reduced to sodium hydroxide. That is, sodium sulfide is not regenerated, and this is also just a "treatment technique" for caustic sludge.

Therefore, based on the above analysis, the technical problem to be solved is to provide a method capable of achieving complete regeneration of mercaptan sodium and sodium sulfide simultaneously, thereby realizing a one-step complete regeneration treatment of liquefied petroleum gas sweetening caustic.

SUMMARY OF THE INVENTION

In order to solve the above technical problems, the goal of the present invention is to provide a complete regeneration method for liquefied petroleum gas sweetening caustic, a method which is capable of completely regenerating both mercaptan sodium and sodium sulfide contained in the caustic simultaneously while reducing the content of polysulfide in the caustic after separation to 5 mg/kg or less. The regeneration method of the present invention completely surmounts the methods of treating liquefied petroleum gas sweetening caustic in the prior art, and is characterized by simple operation, cost saving and beneficial for environment protection.

The present invention provides a regeneration method for liquefied petroleum gas sweetening caustic, wherein the method comprises the step of: under the condition of a sulfonated cobalt phthalocyanine-based catalyst, subjecting the liquefied petroleum gas sweetening caustic after heat exchange to an oxidation reaction so as to complete the regeneration of the liquefied petroleum gas sweetening caustic, wherein the volume ratio of the liquefied petroleum gas sweetening caustic to an oxygen-containing gas is 1:10-500, preferably 1:50-500, and the sulfonated cobalt phthalocyanine-based catalyst is added at a concentration of 10 mg/kg to 300 mg/kg.

According to a specific embodiment of the present invention, in the regeneration method of the present invention, the liquefied petroleum gas sweetening caustic comprises both mercaptan sodium and sodium sulfide.

Furthermore, calculated by elemental sulfur, the content of mercaptan sodium is ≤20000 mg/kg and the content of sodium sulfide is ≤10000 mg/kg in the liquefied petroleum gas sweetening caustic; preferably, the content of mercaptan sodium ranges from 100 mg/kg to 20000 mg/kg and the content of sodium sulfide ranges from 50 mg/kg to 10000 mg/kg in the liquefied petroleum gas sweetening caustic.

Furthermore, the molar ratio of mercaptan sodium to sodium sulfide in the liquefied petroleum gas sweetening caustic is preferably 0.1-200:1; more preferably, the molar ratio of mercaptan sodium to sodium sulfide in the liquefied petroleum gas sweetening caustic is 0.3-100:1.

According to a specific embodiment of the present invention, in the regeneration method of the present invention, the temperature of the liquefied petroleum gas sweetening caustic after heat exchange ranges from 20° C. to 80° C. It can be understood that when the temperature of the liquefied petroleum gas sweetening caustic to be treated is within this range, heat exchange is not required. The "the liquefied petroleum gas sweetening caustic after heat exchange" described in the present invention means that the heat exchange is selectively performed depending on the actual situation. Preferably, the temperature of the liquefied petroleum gas sweetening caustic after heat exchange ranges from 20° C. to 60° C. More preferably, the temperature of the liquefied petroleum gas sweetening caustic after heat exchange ranges from 45° C. to 60° C.

Further, the sulfonated cobalt phthalocyanine-based catalyst used in the oxidation reaction includes, but not limited to, sulfonated cobalt phthalocyanine, dinuclear cobalt phthalocyanine sulfonate, cobalt polyphthalocyanine or a composite catalyst thereof. The low-valent cobalt ions in the catalyst can rapidly react with oxygen to form high-valent cobalt ions with strong oxidizing ability, and the high-valent cobalt ions can further complete the oxidation process of sulfur-containing ions. This process can greatly increase the oxidation rate of sulfur-containing ions. Furthermore, the sulfonated cobalt phthalocyanine-based catalyst is added in an amount of 10-300 mg/kg. Preferably, the sulfonated cobalt phthalocyanine-based catalyst is added in an amount of 10-100 mg/kg.

According to a specific embodiment of the present invention, the regeneration method of liquefied petroleum gas sweetening caustic of the present invention is performed in a Higee reactor.

According to a preferable embodiment of the present invention, the Higee reactor is a rotating packed bed or a stator-rotor reactor other than one using bulk packing. More preferably, the rotating packed bed is equipped with a structured packing or a wire mesh packing.

During the oxidation reaction and separation process of the present invention, the rotating packed bed, which is a relatively common type of Higee reactor, is composed of a motor, a seal, a cavity, a rotor, and an end cap, and the rotor is preferably filled with a structured packing or a wire mesh packing. Since bulk packing has a limited effect on the liquid shear fracture, which impairs the effect of the present invention, a rotating packed bed having a rotor filled with bulk packing is therefore not suitable for the present invention.

According to a specific embodiment of the present invention, the liquid flow in the Higee reactor is a gas-liquid counter-current, gas-liquid co-current or gas-liquid zigzag flow. Preferably, the flow inside the Higee reactor is in the form of a gas-liquid counter-current flow.

Specifically, the regeneration method for liquefied petroleum gas sweetening caustic of the present invention comprises the steps of: under the condition of a sulfonated cobalt phthalocyanine-based catalyst, subjecting the liquefied petroleum gas sweetening caustic to heat exchange before pumping into the liquid inlet of the Higee reactor; entering a flow of oxygen-containing gas at the gas inlet of the Higee reactor, and mixing the gas and the liquid in the Higee reactor to carry out an oxidation reaction so as to complete the regeneration of the liquefied petroleum gas sweetening caustic.

According to a specific embodiment of the present invention, in the regeneration method of liquefied petroleum gas sweetening caustic of the present invention, while the oxidation reaction is carried out by mixing the liquefied petroleum gas sweetening caustic and the oxygen-containing gas in the Higee reactor and contacting with the oxidation catalyst, the disulfide and polysulfide generated are extracted into the gas phase under the condition of a high gas-to-liquid ratio and then discharged, allowing the separation of the disulfide and polysulfide from the caustic and achieving the regeneration of the liquefied petroleum gas sweetening caustic.

According to a specific embodiment of the present invention, in the regeneration method of liquefied petroleum gas sweetening caustic of the present invention, the pressure of the oxidation reaction is from normal pressure to 0.8 MPa (0.1 MPa to 0.8 MPa). Preferably, the pressure of the oxidation reaction ranges from 0.1 MPa to 0.2 MPa.

According to a specific embodiment of the present invention, in the regeneration method of liquefied petroleum gas sweetening caustic of the present invention, the oxidation reaction is carried out at a rotational speed ranging from 100 rpm to 2000 rpm. Preferably, the oxidation reaction is carried out at a rotational speed ranging from 300 rpm to 2000 rpm. More preferably, the rotational speed is between 600 rpm and 1200 rpm.

In the present invention, preferably, the volume ratio of the liquefied petroleum gas sweetening caustic containing both mercaptan sodium and sodium sulfide to the oxygen-containing gas is 1:(100-400), more preferably 1:(120-350). Due to the use of the Higee reactor selected by the present invention, the mass transfer process of the disulfide and polysulfide to the gas phase can be elevated under the condition of a high gas-to-liquid ratio, which facilitates the complete separation of disulfide and polysulfide from the caustic. However, too high a gas-to-liquid ratio may cause gas-liquid entrainment or flooding, which is unfavorable for the gas-liquid mass transfer process, which in turn affects the oxidation of mercaptan sodium and sodium sulfide and the separation of disulfides and polysulfides from caustic.

Furthermore, the oxygen-containing gas is air or an oxygen-rich gas; preferably, the air or oxygen-rich gas has an oxygen content ranging from 21% to 35%.

In the present invention, the disulfide may be represented as $R_1S_2R_2$, and the polysulfide may be represented as $R_1S_nR_2$, ($n \geq 3$), wherein n is preferably 3 to 5; $R_1$ and $R_2$ are alkyl groups, and $R_1$ and $R_2$ may be the same or different and may be a methyl group, an ethyl group, a propyl group or the like.

The disulfide and polysulfide produced in the present invention are extracted into the gas phase to be separated from the caustic, such that the mercaptan sodium and sodium sulfide in the liquefied petroleum gas sweetening caustic are completely converted into sodium hydroxide. The treated caustic is returned to a pre-sweetening unit; that is, the liquefied petroleum gas sweetening caustic is completely regenerated.

In the present invention, after the liquefied petroleum gas sweetening caustic undergoes heat exchange, it is pumped into the liquid inlet of a Higee reactor while a flow of oxygen-containing gas enters the gas inlet of a Higee reactor. The liquid is sheared and divided into tiny droplets, liquid filaments, and liquid membrane by the packing inside the rotor or the stator-rotor structure, providing a large specific surface area for interphase mass transfer and surface renewal rate. The oxygen-containing gas contacts the liquid within the packing or stator-rotor structure, and oxygen is rapidly mass-transferred to the liquid phase and, under the action of an oxidation catalyst, undergoes the oxidation reaction while the disulfide and polysulfide are rapidly mass-transferred into the gas phase (the separation process), so that the regeneration of the liquefied petroleum gas sweetening caustic is completed. The resultant regenerated caustic and the oxidized off-gas containing disulfide and polysulfide are leave the reactor from the liquid outlet and gas outlet of the Higee reactor, respectively. The oxidized off-gas containing sulfur enters an off-gas treatment unit to be treated, and the regenerated caustic is returned to a sweetening unit for reuse.

The complete regeneration method for liquefied petroleum gas sweetening caustic of the present invention is carried out in a specific Higee reactor. The reactor simulates a supergravity field with a centrifugal field to effectively enhance micro-mixing and phase-to-phase transfer in multiphase reactions, which overcomes the deficiency of traditional oxidation towers in the mass transfer process to a certain extent and increases the mass transfer coefficient of oxygen molecules at the caustic/oxygen-containing gas phase boundary, indirectly increasing the availability of oxygen molecules.

Thus, the complete regeneration method of liquefied petroleum gas sweetening caustic of the present invention is particularly suitable for treating a liquefied petroleum gas sweetening caustic containing both mercaptan sodium and sodium sulfide. With the regeneration method of the present invention, mercaptan sodium and sodium sulfide contained in liquefied petroleum gas sweetening caustic can be completely converted to disulfide and polysulfide and sodium hydroxide, which eliminates the sodium thiosulfate accumulation issue, such that liquefied petroleum gas sweetening caustic can be completely regenerated.

Through experiments, the inventors have unexpectedly found a method capable of completely regenerating the liquefied petroleum gas sweetening caustic according to the present invention. Due to the use of a specific mercaptan reactor and a large gas-to-liquid ratio, the process of regenerating mercaptan sodium and sodium sulfide and the process of separating disulfide and polysulfide may be combined under the synergistic effect, which leads to complete regeneration of the caustic containing mercaptan sodium and sodium sulfide without generating sodium thiosulfate. Based on the results from testing the caustic, the inventors propose a possible reaction scheme as follows:

$$(n-2)Na_2S+2NaSR+(n-1)H_2O+(0.5n-0.5)O_2 \rightarrow (2n-2)NaOH+R_1S_nR_2 \quad n\geq 3$$

wherein n is preferably 3 to 5; R, $R_1$ and $R_2$ are alkyl groups, and R, $R_1$ and $R_2$ may be the same or different and may be a methyl group, an ethyl group, a propyl group or the like.

Under the action of a sulfonated cobalt phthalocyanine-based catalyst, mercaptan sodium and sodium sulfide are rapidly oxidized into sodium hydroxide and polysulfide by the large amount of oxygen molecules diffused across the gas-liquid interface. At the same time, polysulfide ($R_1SnR_2$, n≥3) is promoted to be rapidly separated from the caustic under the condition of large gas-to-liquid ratio, which avoids further oxidation of the polysulfide ($R_1SnR_2$, n≥3) under the condition of an oxidizing atmosphere for a prolonged duration, thereby achieving one-step complete regeneration of mercaptan sodium and sodium sulfide.

Therefore, in the present invention, the liquefied petroleum gas sweetening caustic contains both mercaptan sodium and sodium sulfide. If the sweetening caustic contained only sodium sulfide, it would be impossible to obtain a regenerated caustic but caustic sludge by using the processes according to the present invention.

The regeneration method for liquefied petroleum gas sweetening caustic of the present invention does not require the use of pure oxygen, reverse extraction solvents or equipment, and can effectively remove the mercaptan sodium and sodium sulfide impurities in the caustic.

With the one-step complete regeneration method of liquefied petroleum gas sweetening caustic of the present invention, the contents of mercaptan sodium and sodium sulfide in the refined caustic can be controlled to at 500 mg/kg or less, and the total content of disulfide and polysulfide can be reduced to 5 mg/kg or less. Moreover, the content of sodium thiosulfate can be reduced to 100 mg/kg or less. The disulfide and polysulfide detected are generally dimethyl disulfide, methyl ethyl disulfide, diethyl disulfide, dimethyl trisulfide, and the like.

In order to achieve the complete regeneration treatment of liquefied petroleum gas sweetening caustic containing both mercaptan sodium and sodium sulfide, in the present invention, a Higee reactor, particularly the preferred Higee reactor, is used together with particular conditions for the oxidation reaction. Due to the synergistic effect thereof, a breakthrough over the various reaction conditions and principles in the prior art is achieved, which led to the realization of simultaneous treatment of mercaptan sodium and sodium sulfide. Through extensive studies, it is probed how the degree at which the gas/liquid phases are mixed during the oxidation reaction may affect the reaction, and a suitable Higee reactor mode and gas-to-liquid ratio are chosen.

The regeneration method for liquefied petroleum gas sweetening caustic of the present invention has a simple process, easy operation, and low cost, and may be easily popularized.

The present invention has the following advantages:

1. The regeneration method of the present invention unprecedently realizes complete regeneration of liquefied petroleum gas sweetening caustic containing both mercaptan sodium and sodium sulfide, wherein the mercaptan sodium and sodium sulfide are converted to sodium hydroxide by means of a specific Higee reactor.

2. Existing methods in the prior art require multiple separations or transformations during processing to effective treatment of the liquefied petroleum gas sweetening caustic. However, the present invention unprecedently allows the oxidation reaction and the separation process to be simultaneously carried out in the reactor, which realizes the technological innovation in one-step complete treatment. It has the characteristics of a simple processing procedure, low operation difficulty and low processing cost and may therefore be more easily popularized.

DESCRIPTION OF EMBODIMENTS

In order to provide a better understanding of the technical features, objects, and advantages of the present invention, the technical solutions of the present invention are described in detail below as examples, which cannot be construed as limitation to the scope of the invention.

Here, at the presence of a sulfonated cobalt phthalocyanine-based catalyst, the liquefied petroleum gas sweetening caustic containing both mercaptan sodium and sodium sulfide undergoes heat exchange before being pumped into the liquid inlet of a Higee reactor. The liquid is sheared and divided into tiny droplets, liquid filaments, and liquid membrane by a high-speed rotating rotor, providing a large specific surface area for interphase mass transfer and a rapidly renewing interphase surface. An oxygen-containing gas is metered through a flow meter and enters the gas inlet, and the gas and liquid are mixed in the rotor of a rotating packed bed or in the stator-rotor structure where an intense gas-liquid mass transfer process takes place. The oxidation reaction of mercaptan sodium and sodium sulfide as well as the separation of the generated disulfide and polysulfide from the caustic are then accomplished, thereby completing the regeneration of the liquefied petroleum gas sweetening caustic. The regenerated caustic and the oxidized off-gas containing disulfide and polysulfide are discharged from the liquid outlet and gas outlet of the Higee reactor, respectively. The regenerated caustic after deoxidation is returned to a sweetening unit for reuse, and the oxidized off-gas containing disulfide and polysulfide is sent to an off-gas treatment unit.

The concentration of mercaptan sodium (NaSR) and sodium sulfide in the regenerated caustic is determined by potentiometric titration. The method for the determination of the concentration of disulfide and polysulfide (collectively referred to as sulfides $R_1S_mR_2$, m≥2, in the following tables) in the regenerated caustic is as follows: after the caustic is extracted three times with n-hexane, the extractant is analyzed by a coulometric analyzer. The method for the determination of the sodium thiosulfate concentration in the regenerated caustic includes: acidification to pH 6 by acetic acid, introducing nitrogen gas to eliminate the interference of hydrogen sulfide and mercaptan, and adding formaldehyde to eliminate the interference of sulfite ions, followed by determination with the iodometric method.

Here, R, $R_1$ and $R_2$ are alkyl groups, and R, $R_1$ and $R_2$ may be the same or different and may be a methyl group, an ethyl group, a propyl group or the like.

EXAMPLE 1

This example provides a one-step complete regeneration method for liquefied petroleum gas sweetening caustic, comprising the following steps:

Under the condition of a sulfonated cobalt phthalocyanine catalyst having a concentration of 300 mg/kg, the liquefied petroleum gas sweetening caustic containing both mercaptan sodium and sodium sulfide was heat exchanged to a temperature of 55° C. and pumped into the liquid inlet of a Higee reactor using wire mesh packing. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, and the gas and liquid were mixed in the rotor of the Higee reactor where an intense gas-liquid mass transfer process took place. The oxidation reaction of mercaptan sodium and sodium sulfide as well as the separation of the formed disulfide and polysulfide from the caustic were then accomplished, thereby completing the regeneration of the liquefied petroleum gas sweetening caustic. The regenerated caustic and the oxidized off-gas containing disulfide and polysulfide were discharged at the liquid outlet and gas outlet of the Higee reactor, respectively. The regenerated caustic after deoxidation was returned to a sweetening unit for reuse, and the oxidized off-gas containing disulfide and polysulfide was sent to an off-gas treatment unit. In the Higee reactor, the gas-liquid ratio was 300:1 (v/v), the rotational speed was 1100 rpm, and the operating pressure was 0.15 MPa. The caustic compositions before and after the reaction are shown in Table 1.

TABLE 1

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 20000 | 10000 | 0 | 0 |
| Product | 350 | 250 | 9 | 1 |

EXAMPLE 2

This example provides a one-step complete regeneration method for liquefied petroleum gas sweetening caustic, comprising the following steps:

Under the condition of a dinuclear cobalt phthalocyanine sulfonate catalyst having a concentration of 100 mg/kg, the liquefied petroleum gas sweetening caustic containing both mercaptan sodium and sodium sulfide was heat exchanged to a temperature of 45° C. and pumped into the liquid inlet of a Higee reactor using monolithic foamed silicon carbide as structured packing. The liquid was sheared and divided into tiny liquid membranes, filaments and droplets by a high-speed rotating rotor, providing a large specific surface area for interphase mass transfer and a rapidly renewing interphase surface. An oxygen-rich gas (having an oxygen content of 35%) was metered through a flow meter and entered the gas inlet, and the gas and liquid were mixed in the rotor of the Higee reactor where an intense gas-liquid mass transfer process took place. The oxidation reaction of mercaptan sodium and sodium sulfide as well as the separation of the formed disulfide and polysulfide from the caustic were then accomplished, thereby completing the regeneration of the liquefied petroleum gas sweetening caustic. The regenerated caustic and the oxidized off-gas containing disulfide and polysulfide were discharged at the liquid outlet and gas outlet of the Higee reactor, respectively. The regenerated caustic after deoxidation was returned to a sweetening unit for reuse, and the oxidized off-gas containing disulfide and polysulfide was sent to an off-gas treatment unit. Here, in the Higee reactor, the gas-liquid ratio was 250:1 (v/v), the rotational speed was 900 rpm, and the operating pressure was 0.6 MPa. The caustic compositions before and after the reaction are shown in Table 2.

TABLE 2

| Content (in terms of elemental sulfur) mg/kg | mercaptan sodium NaSR | sodium sulfide $Na_2S$ | Sulfides $R_1S_mR_2$ | Sodium thiosulfate $Na_2S_2O_3$ |
|---|---|---|---|---|
| Feed | 10000 | 3000 | 0 | 0 |
| Product | 140 | 70 | 4 | 2 |

EXAMPLE 3

This example provides a one-step complete regeneration method for liquefied petroleum gas sweetening caustic, comprising the following steps:

Under the condition of a sulfonated cobalt phthalocyanine catalyst having a concentration of 10 mg/kg, the liquefied petroleum gas sweetening caustic containing both mercaptan sodium and sodium sulfide was heat exchanged to a temperature of 55° C. and pumped into the liquid inlet of a Higee reactor using a stator-rotor structure. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, the gas and liquid were mixed in the stator-rotor reactor where an intense gas-liquid mass transfer process took place, thus the oxidation reaction of mercaptan sodium and sodium sulfide as well as the separation of the formed disulfide and polysulfide from the caustic were accomplished, thereby completing the regeneration of the liquefied petroleum gas sweetening caustic. The regenerated caustic and the oxidized off-gas containing disulfide and polysulfide were discharged at the liquid outlet and gas outlet of the Higee reactor, respectively. The regenerated caustic after deoxidation was returned to a sweetening unit for reuse, and the oxidized off-gas containing disulfide and polysulfide was sent to an off-gas treatment unit. Here in the Higee reactor, the gas-liquid ratio was 100:1 (v/v), the rotational speed was 500 rpm, and the operating pressure was 0.1 MPa. The caustic compositions before and after the reaction are shown in Table 3.

TABLE 3

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 100 | 50 | 0 | 0 |
| Product | <8 | <4 | <1 | <1 |

EXAMPLE 4

This example provides a one-step complete regeneration method for liquefied petroleum gas sweetening caustic, comprising the following steps:

Under the condition of a cobalt polyphthalocyanine catalyst having a concentration of 200 mg/kg, the liquefied petroleum gas sweetening caustic containing both mercaptan sodium and sodium sulfide was heat exchanged to a temperature of 55° C. and pumped into the liquid inlet of a Higee reactor using wire mesh packing. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, and the gas and liquid were mixed in the rotor of the Higee reactor where an intense gas-liquid mass transfer process took place. The oxidation reaction of mercaptan sodium and sodium sulfide as well as the separation of the formed disulfide and polysulfide from the caustic were thus accomplished, thereby completing the regeneration of the liquefied petroleum gas sweetening caustic. The regenerated caustic and the oxidized off-gas containing disulfide and polysulfide were discharged at the liquid outlet and gas outlet of the Higee reactor, respectively. The regenerated caustic after deoxidation was returned to a sweetening unit for reuse, and the oxidized off-gas containing disulfide and polysulfide was sent to an off-gas treatment unit. Here in the Higee reactor, the gas-liquid ratio was 150:1 (v/v), the rotational speed was 1000 rpm, and the operating pressure was 0.3 MPa. The caustic compositions before and after the reaction are shown in Table 4.

TABLE 4

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 5000 | 1000 | 0 | 0 |
| Product | 28 | 16 | 2 | <1 |

EXAMPLE 5

This example provides a one-step complete regeneration method for liquefied petroleum gas sweetening caustic, comprising the following steps:

Under the condition of a composite catalyst of sulfonated cobalt phthalocyanine and dinuclear cobalt phthalocyanine sulfonate (sulfonated cobalt phthalocyanine:dinuclear cobalt phthalocyanine sulfonate=1:1 w/w) having a concentration of 100 mg/kg, the liquefied petroleum gas sweetening caustic containing both mercaptan sodium and sodium sulfide was heat exchanged to a temperature of 50° C. and pumped into the liquid inlet of a Higee reactor using wire mesh packing. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, the gas and liquid were mixed in the rotor of the Higee reactor where an intense gas-liquid mass transfer process took place, and the oxidation reaction of mercaptan sodium and sodium sulfide as well as the separation of the formed disulfide and polysulfide from the caustic were then accomplished. A flow of oxygen-containing gas was introduced into the gas inlet via a flow meter, and the gas and liquid were mixed in the Higee reactor, thereby completing the regeneration of the liquefied petroleum gas sweetening caustic. The regenerated caustic after deoxidation was returned to a sweetening unit for reuse, and the oxidized off-gas containing disulfide and polysulfide was sent to an off-gas treatment unit. Here, in the Higee reactor, the gas-liquid ratio was 300:1 (v/v), the rotational speed was 1000 rpm, and the operating pressure was 0.5 MPa. The caustic compositions before and after the reaction are shown in Table 5.

TABLE 5

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 2000 | 1800 | 0 | 0 |
| Product | 48 | 31 | 4 | 2 |

EXAMPLE 6

This example provides a one-step complete regeneration method for liquefied petroleum gas sweetening caustic, comprising the following steps:

Under the condition of a dinuclear cobalt phthalocyanine sulfonate catalyst having a concentration of 100 mg/kg, the liquefied petroleum gas sweetening caustic containing both mercaptan sodium and sodium sulfide was heat exchanged to a temperature of 50° C. and pumped into the liquid inlet of a Higee reactor using wire mesh packing. The liquid was sheared and divided into tiny liquid membranes, filaments and droplets by high-speed rotating rotor, providing a large specific surface area for interphase mass transfer and a rapidly renewing interphase surface. Air was metered through a flow meter and entered the gas inlet, the gas and liquid were mixed in the rotor of the Higee reactor where an intense gas-liquid mass transfer process took place, and the oxidation reaction of mercaptan sodium and sodium sulfide and the separation of the formed disulfide and polysulfide from the caustic were thus accomplished. A flow of oxygen-containing gas was introduced into the gas inlet via a flow meter, and the gas and liquid were mixed in the Higee reactor, thereby completing the regeneration of the liquefied petroleum gas sweetening caustic. The regenerated caustic after deoxidation was returned to a sweetening unit for reuse, and the oxidized off-gas containing disulfide and polysulfide was sent to an off-gas treatment unit. Here in the Higee reactor, the gas-liquid ratio was 150:1 (v/v), the rotational speed was 300 rpm, and the operating pressure was 0.3 MPa. The caustic compositions before and after the reaction are shown in Table 6.

TABLE 6

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 2500 | 400 | 0 | 0 |
| Product | 28 | 16 | 2 | 1 |

EXAMPLE 7

This example provides a one-step complete regeneration method for liquefied petroleum gas sweetening caustic, comprising the following steps:

Under the condition of a cobalt polyphthalocyanine catalyst having a concentration of 100 mg/kg, the liquefied petroleum gas sweetening caustic containing both mercaptan sodium and sodium sulfide was heat exchanged to a temperature of 45° C. and pumped into the liquid inlet of a Higee reactor using a stator-rotor structure. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, and the gas and liquid were mixed in the stator-rotor reactor where an intense gas-liquid mass transfer process took place. The oxidation reaction of mercaptan sodium and sodium sulfide and the separation of the formed disulfide and polysulfide from the caustic were then accomplished, thereby completing the regeneration of the liquefied petroleum gas sweetening caustic. The regenerated caustic and the oxidized off-gas containing disulfide and polysulfide were discharged at the liquid outlet and gas outlet of the Higee reactor, respectively. The regenerated caustic after deoxidation was returned to a sweetening unit for reuse, and the oxidized off-gas containing disulfide and polysulfide was sent to an off-gas treatment unit. Here in the supergravity reactor, the gas-liquid ratio was 200:1 (v/v), the rotational speed was 600 rpm, and the operating pressure was 0.2 MPa. The caustic compositions before and after the reaction are shown in Table 7.

TABLE 7

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 3000 | 700 | 0 | 0 |
| Product | 110 | 33 | 3 | 2 |

EXAMPLE 8

This example provides a regeneration method for liquefied petroleum gas sweetening caustic, comprising the following steps:

With 300 mg/kg of sulfonated cobalt phthalocyanine, the liquefied petroleum gas sweetening caustic was subjected to heat exchange to reach a temperature of 60° C. and pumped into the liquid inlet of a Higee reactor; a flow of oxygen-containing gas entered the gas inlet via a flow meter, and the gas and the liquid were mixed in the Higee reactor to complete the regeneration of the liquefied petroleum gas sweetening caustic, with a gas-liquid ratio of 500:1 (v/v), a rotational speed of 2000 rpm, and an operating pressure at atmospheric pressure. The caustic compositions before and after the reaction are shown in Table 8.

TABLE 8

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 20000 | 10000 | 0 | 0 |
| Product | 300 | 200 | 4 | <1 |

EXAMPLE 9

This example provides a regeneration method for liquefied petroleum gas sweetening caustic, comprising the following steps:

With 100 mg/kg of sulfonated cobalt phthalocyanine, the liquefied petroleum gas sweetening caustic was subjected to heat exchange to reach a temperature of 40° C. and pumped into the liquid inlet of a Higee reactor; a flow of oxygen-containing gas entered the gas inlet via a flow meter, and the gas and the liquid were mixed in the Higee reactor to complete the regeneration of the liquefied petroleum gas sweetening caustic, with a gas-liquid ratio of 400:1 (v/v), a rotational speed of 1000 rpm, and an operating pressure at 0.8 MPa. The caustic compositions before and after the reaction are shown in Table 9.

TABLE 9

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 10000 | 3000 | 0 | 0 |
| Product | 100 | 50 | 2 | <1 |

EXAMPLE 10

This example provides a regeneration method for liquefied petroleum gas sweetening caustic, comprising the following steps:

With 10 mg/kg of sulfonated cobalt phthalocyanine, the liquefied petroleum gas sweetening caustic was subjected to heat exchange to reach a temperature of 20° C. and pumped into the liquid inlet of a Higee reactor; a flow of oxygen-containing gas entered the gas inlet via a flow meter, and the gas and the liquid were mixed in the Higee reactor to complete the regeneration of the liquefied petroleum gas sweetening caustic, with a gas-liquid ratio of 50:1 (v/v), a rotational speed of 300 rpm, and an operating pressure at atmospheric pressure. The caustic compositions before and after the reaction are shown in Table 10.

TABLE 10

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 100 | 50 | 0 | 0 |
| Product | <10 | <5 | <1 | <1 |

EXAMPLE 11

This example provides a regeneration method for liquefied petroleum gas sweetening caustic, comprising the following steps:

With 200 mg/kg of sulfonated cobalt phthalocyanine, the liquefied petroleum gas sweetening caustic was subjected to heat exchange to reach a temperature of 50° C. and pumped into the liquid inlet of a Higee reactor; a flow of oxygen-containing gas entered the gas inlet via a flow meter, and the gas and the liquid were mixed in the Higee reactor to complete the regeneration of the liquefied petroleum gas sweetening caustic, with a gas-liquid ratio of 100:1 (v/v), a rotational speed of 800 rpm, and an operating pressure at 0.3 MPa. The caustic compositions before and after the reaction are shown in Table 11.

TABLE 11

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 5000 | 1000 | 0 | 0 |
| Product | 30 | 20 | 3 | <1 |

EXAMPLE 12

This example provides a regeneration method for liquefied petroleum gas sweetening caustic, comprising the following steps:

With 100 mg/kg of sulfonated cobalt phthalocyanine, the liquefied petroleum gas sweetening caustic was subjected to heat exchange to reach a temperature of 45° C. and pumped into the liquid inlet of a Higee reactor; a flow of oxygen-containing gas entered the gas inlet via a flow meter, and the gas and the liquid were mixed in the Higee reactor to complete the regeneration of the liquefied petroleum gas sweetening caustic, with a gas-liquid ratio of 300:1 (v/v), a rotational speed of 1200 rpm, and an operating pressure at 0.4 MPa. The caustic compositions before and after the reaction are shown in Table 12.

TABLE 12

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 2000 | 1800 | 0 | 0 |
| Product | 50 | 30 | 3 | <1 |

EXAMPLE 13

This example provides a regeneration method for liquefied petroleum gas sweetening caustic, comprising the following steps:

With 100 mg/kg of sulfonated cobalt phthalocyanine, the liquefied petroleum gas sweetening caustic was subjected to heat exchange to reach a temperature of 55° C. and pumped into the liquid inlet of a Higee reactor; a flow of oxygen-containing gas entered the gas inlet via a flow meter, and the gas and the liquid were mixed in the Higee reactor to complete the regeneration of the liquefied petroleum gas sweetening caustic, with a gas-liquid ratio of 150:1 (v/v), a rotational speed of 400 rpm, and an operating pressure at 0.1 MPa. The caustic compositions before and after the reaction are shown in Table 13.

TABLE 13

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 2500 | 400 | 0 | 0 |
| Product | 30 | 15 | 2 | <1 |

COMPARATIVE EXAMPLE 1

In this comparative example, 300 mL of caustic containing mercaptan sodium and sodium sulfide was added to a 500 mL glass flask, and air was introduced through an air duct at the bottom of the flask. Under a nitrogen flow rate of 150 L/h, a reaction was carried out for 1 h at a temperature of 60° C. and a stirring speed of 2000 rpm, with 300 mg/kg of sulfonated cobalt phthalocyanine. The operation was performed under atmospheric pressure. The caustic compositions before and after the reaction are shown in Table 14.

TABLE 14

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 20000 | 10000 | 0 | 0 |
| Product | 3500 | 1800 | 650 | 8500 |

COMPARATIVE EXAMPLE 2

In this comparative example, 300 mL of caustic containing mercaptan sodium and sodium sulfide was added to a 500 mL glass flask, and air was introduced through an air duct at the bottom of the flask. Under a nitrogen flow rate of 15 L/h, the reaction was carried out for 1 h at a temperature of 20° C. and a stirring speed of 300 rpm, with 10 mg/kg of sulfonated cobalt phthalocyanine. The operation was performed under atmospheric pressure. The caustic compositions before and after the reaction are shown in Table 15.

TABLE 15

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 100 | 50 | 0 | 0 |
| Product | 28 | 15 | 11 | 57 |

COMPARATIVE EXAMPLE 3

In this comparative example, 300 mL of caustic containing mercaptan sodium and sodium sulfide was added to a 500 mL glass flask, and air was introduced through an air duct at the bottom of the flask. Under an oxygen-containing gas flow rate of 150 L/h, the reaction was carried out for 1 h at a temperature of 60° C. and a stirring speed of 1200 rpm, with a sulfonated cobalt phthalocyanine catalyst having a concentration of 10 mg/kg. The operation was performed under atmospheric pressure. The caustic compositions before and after the reaction are shown in Table 16.

TABLE 16

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 20000 | 10000 | 0 | 0 |
| Product | 4000 | 1900 | 700 | 8600 |

COMPARATIVE EXAMPLE 4

In this comparative example, 300 mL of caustic containing mercaptan sodium and sodium sulfide was added to a 500 mL glass flask, and air was introduced through an air duct at the bottom of the flask. Under an air flow rate of 15 L/h, the reaction was carried out for 1 h at a temperature of 50° C. and a stirring speed of 300 rpm, with a sulfonated cobalt phthalocyanine catalyst having a concentration of 10 mg/kg. The operation was performed under atmospheric pressure. The caustic compositions before and after the reaction are shown in Table 17.

TABLE 17

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 100 | 50 | 0 | 0 |
| Product | 26 | 13 | 10 | 55 |

COMPARATIVE EXAMPLE 5

This comparative example was carried out in the same manner as in Example 1, except that the sulfonated cobalt phthalocyanine catalyst was not included. The liquefied petroleum gas sweetening caustic containing both mercaptan sodium and sodium sulfide was heat exchanged to a temperature of 55° C. and pumped into the liquid inlet of a Higee reactor using wire mesh packing. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered from the gas inlet, and the gas and liquid were mixed in the rotor of the Higee reactor where an intense gas-liquid mass transfer process took place. Since the necessary oxidation catalyst was not included, neither mercaptan sodium nor sodium sulfide in the caustic could undergo an oxidation reaction. The regenerated caustic and the oxidized off-gas were discharged at the liquid outlet and gas outlet of the Higee reactor, respectively. The unregenerated caustic was sent to a waste water treatment unit after being diluted at a large ratio. Here, in the Higee reactor, the gas-liquid ratio was 300:1 (v/v), the rotational speed applied was 1100 rpm, and the operating pressure was 0.15 MPa. The caustic compositions before and after the reaction are shown in Table 18.

TABLE 18

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 20000 | 10000 | 0 | 0 |
| Product | 20000 | 10000 | 0 | 0 |

COMPARATIVE EXAMPLE 6

In this comparative example, the gas-liquid ratio was 80:1 (v/v) in the Higee reactor. Under the condition of a sulfonated cobalt phthalocyanine catalyst having a concentration of 8 mg/kg, the rotational speed applied was 300 rpm, and the operating pressure was 0.1 MPa. The liquefied petroleum gas sweetening caustic containing both mercaptan sodium and sodium sulfide was heat exchanged to a temperature of 20° C. and pumped into the liquid inlet of a Higee reactor using wire mesh packing. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, and the gas and liquid were mixed in the rotor of the Higee reactor where an intense gas-liquid mass transfer process took place. Due to the small gas-liquid ratio, the oxidation reaction of mercaptan sodium and sodium sulfide was not complete, and sodium sulfide was not completely converted into sulfide and sodium hydroxide. Also, the separation process of the generated disulfide and polysulfide from the caustic was not complete, and thus a complete regeneration of the liquefied petroleum gas sweetening caustic was not achieved. The partially regenerated caustic and the oxidized off-gas containing disulfide and polysulfide were discharged at the liquid outlet and gas outlet of the Higee reactor, respectively. The partially regenerated caustic was diluted and sent to a waste water treatment unit, and the oxidized off-gas containing disulfide and polysulfide was sent to an off-gas treatment unit. The caustic compositions before and after the reaction are shown in Table 19.

TABLE 19

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 20000 | 10000 | 0 | 0 |
| Product | 13000 | 2900 | 2374 | 6679 |

COMPARATIVE EXAMPLE 7

This comparative example was carried out in the same manner as in Example 1, except that the caustic to be treated was different. Under the condition of a sulfonated cobalt phthalocyanine catalyst having a concentration of 300 mg/kg, the liquefied petroleum gas sweetening caustic containing only mercaptan sodium was heat exchanged to a temperature of 55° C. and pumped into the liquid inlet of a Higee reactor using wire mesh packing. The liquid was sheared and divided into tiny liquid membranes, filaments and droplets by a high-speed rotating rotor, providing a large specific surface area for interphase mass transfer and a rapidly renewing interphase surface. Air was metered through a flow meter and entered the gas inlet, and the gas and liquid were mixed in the rotor of the Higee reactor where an intense gas-liquid mass transfer process took place and an oxidation reaction of sodium sulfide was accomplished. The caustic and oxidized off-gas having undergone the non-hazardous treatment process were discharged at the liquid outlet and gas outlet of the Higee reactor, respectively. The caustic was sent to a waste water treatment unit, and the oxidized off-gas was sent to an off-gas treatment unit. Here in the Higee reactor, the gas-liquid ratio was 300:1 (v/v), the rotational speed was 1100 rpm, and the operating pressure was 0.15 MPa. The caustic compositions before and after the reaction are shown in Table 20.

TABLE 20

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 0 | 10000 | 0 | 0 |
| Product | 0 | 1460 | 0 | 8540 |

COMPARATIVE EXAMPLE 8

This comparative example was carried out in the same manner as in Example 2, except that the type of Higee reactor and the gas-liquid ratio were different. Under the condition of a dinuclear cobalt phthalocyanine sulfonate catalyst having a concentration of 100 mg/kg, the liquefied petroleum gas sweetening caustic containing both mercaptan sodium and sodium sulfide was heat exchanged to a temperature of 45° C. and pumped into the liquid inlet of a Higee reactor using foam metal bulk particle packing with a diameter of 5 mm. Because the liquid could not be well sheared and divided by the bulk particle packing, the increase in surface area for interphase mass transfer and the interphase surface renewal rate was limited. A flow of oxygen-rich gas (having an oxygen content of 35%) was metered through a flow meter and entered the gas inlet, and the gas and liquid were mixed in the rotor of the Higee reactor where an intense gas-liquid mass transfer process took place. Because the increase in specific surface area for interphase mass transfer and the interphase surface renewal rate were limited, the mass transfer process of oxygen to the liquid phase could not meet the requirement for a complete regeneration of the caustic. As a result, the oxidation reaction of mercaptan sodium and sodium sulfide and the separation process of the formed disulfide and polysulfide from the caustic were incomplete, resulting in an inadequate regeneration of liquefied petroleum gas sweetening caustic. The partially regenerated caustic and the oxidized off-gas containing disulfide and polysulfide were discharged through the liquid outlet and gas outlet of the Higee reactor, respectively. The partially regenerated caustic was diluted and sent to a waste water treatment unit, and the oxidized off-gas containing disulfide and polysulfide was sent to an off-gas treatment unit. Here in the Higee reactor, the gas-liquid ratio was 80:1 (v/v), the rotational speed was 900 rpm, and the operating pressure was 0.6 MPa. The caustic compositions before and after the reaction are shown in Table 21.

TABLE 21

| Content (in terms of elemental sulfur) mg/kg | Mercaptan sodium NaSR | Sodium sulfide $Na_2S$ | Sulfides $R_1S_mR_2$ | Sodium thiosulfate $Na_2S_2O_3$ |
|---|---|---|---|---|
| Feed | 10000 | 3000 | 0 | 0 |
| Product | 6300 | 1560 | 561 | 979 |

By comparing the above Examples and Comparative Examples, it can be seen that the regeneration method of liquefied petroleum gas sweetening caustic of the present invention has a simple procedure, and is capable of regenerating mercaptan sodium and sodium sulfide in a caustic to sodium hydroxide, disulfide, and polysulfide, where the disulfide and polysulfide in the caustic is eliminated to a content of less than 5 mg/kg.

The above descriptions are only specific embodiments of the present invention, the scope of protection of the present invention is not limited thereto. Various changes or substitutions apparent to those skilled in the art within the scope of the present disclosure are intended to be encompassed within the protection scope of the invention.

What is claimed is:

1. A regeneration method for caustic from sweetened liquefied petroleum gas, wherein the method comprises:

under the action of a sulfonated cobalt phthalocyanine-based catalyst, subjecting caustic from sweetened liquefied petroleum gas to heat exchange before pumping into the liquid inlet of a Higee reactor; entering an oxygen-containing gas into the gas inlet of the Higee reactor, and mixing together the oxygen-containing gas and the liquid comprising the caustic and the catalyst in the Higee reactor to carry out an oxidation reaction to regenerate the caustic, wherein the volume ratio of the caustic to the oxygen-containing gas is 1:100-400, and the sulfonated cobalt phthalocyanine-based catalyst is added to the caustic at a concentration ranging from 10 mg/kg to 300 mg/kg, wherein the caustic from sweetened liquefied petroleum gas comprises mercaptan sodium and sodium sulfide, and wherein the caustic from sweetened liquefied petroleum gas is the caustic obtained after liquefied petroleum gas is sweetened by alkaline washing in a refining process, wherein while the oxidation reaction is carried out by mixing the caustic and the oxygen-containing gas in the Higee reactor and contacting with the oxidation catalyst, disulfide and polysulfide generated in the oxidation reaction are extracted into the gas phase under the condition of the caustic to gas volume ratio and the gas containing the disulfide and polysulfide is removed from the Higee reactor, resulting in caustic that has been regenerated.

2. The regeneration method according to claim 1, wherein, in terms of elemental sulfur, the content of mercaptan sodium is ≤20000 mg/kg and the content of sodium sulfide is ≤10000 mg/kg in the caustic from sweetened liquefied petroleum gas.

3. The regeneration method according to claim 1, wherein the molar ratio of mercaptan sodium to sodium sulfide in the caustic from sweetened liquefied petroleum gas is 0.1-200:1.

4. The regeneration method according to claim 1, wherein the temperature of the caustic from sweetened liquefied petroleum gas after heat exchange ranges from 20° C. to 80° C.

5. The regeneration method according to claim 1, wherein the sulfonated cobalt phthalocyanine-based catalyst is sulfonated cobalt phthalocyanine, dinuclear cobalt phthalocyanine sulfonate, cobalt polyphthalocyanine or a composite catalyst thereof.

6. The regeneration method according to claim 1, wherein the sulfonated cobalt phthalocyanine-based catalyst is added in an amount of 10-100 mg/kg with respect to the caustic from sweetened liquefied petroleum gas.

7. The regeneration method according to claim 1, wherein the Higee reactor is a stator-rotor reactor, or a rotating packed bed other than one using bulk particulate packing.

8. The regeneration method according to claim 1, wherein the liquid flow in the Higee reactor is a gas-liquid counter-current, gas-liquid co-current or gas-liquid baffling flow.

9. The regeneration method according to claim 1, wherein the pressure of the oxidation reaction ranges from normal pressure to 0.8 MPa.

10. The regeneration method according to claim 1, wherein the oxidation reaction is carried out at a rotational speed between 100 rpm and 2000 rpm.

11. The regeneration method according to claim 1, wherein the oxygen-containing gas is air or an oxygen-rich gas.

12. The regeneration method according to claim 2, wherein the content of mercaptan sodium ranges from 100 mg/kg to 20000 mg/kg and the content of sodium sulfide is 50 mg/kg to 10000 mg/kg in the caustic from sweetened liquefied petroleum gas.

13. The regeneration method according to claim 3, wherein the molar ratio of mercaptan sodium to sodium sulfide in the caustic from sweetened liquefied petroleum gas is 0.3-100:1.

14. The regeneration method according to claim 7, wherein the rotating packed bed is equipped with the packing of a structured packing or a wire mesh packing.

* * * * *